United States Patent [19]

Krock et al.

[11] 3,930,849

[45] Jan. 6, 1976

[54] ELECTRICAL CONTACT MATERIAL OF THE AG-CDO TYPE AND METHOD OF MAKING SAME

[75] Inventors: Richard H. Krock, Weston; Yuan-Shou Shen, Reading, both of Mass.

[73] Assignee: P. R. Mallory & Co., Inc., Indianapolis, Ind.

[22] Filed: May 24, 1973

[21] Appl. No.: 363,592

[52] U.S. Cl. ..... 75/173 A; 29/182.5; 148/20.3; 148/32

[51] Int. Cl.[2] ..... C22C 5/00

[58] Field of Search ..... 75/173 A

[56] References Cited

UNITED STATES PATENTS

| | | | |
|---|---|---|---|
| 2,796,346 | 6/1957 | Stumbock | 75/173 A |
| 3,472,654 | 10/1969 | Comey et al. | 75/173 A |
| 3,607,244 | 9/1971 | Kabayama | 75/173 A |
| 3,694,197 | 9/1972 | Zdanuk et al. | 75/173 A |
| 3,694,198 | 9/1972 | Krock et al. | 75/173 A |

*Primary Examiner*—L. Dewayne Rutledge
*Assistant Examiner*—E. L. Weise
*Attorney, Agent, or Firm*—Charles W. Hoffmann; Robert F. Meyer; Donald W. Hanson

[57] ABSTRACT

Ag-CdO type material suitable for use as an electrical contact material in a switching device such as a circuit breaking device is disclosed. The material contains Ag and CdO with an oxide of Sn and an oxide of an additive metal selected from Mg, Ca, or mixtures of oxides of such additive metals. The additive metal appears to form an oxide of the metal earlier during oxidation of the material than either the Sn or Cd thereby acting as a nucleating site for the formation of the oxides of the Sn and Cd. The oxide of the metals appears to tend to grow as a mixture of the oxides of the additive metal, Cd and Sn. This material has good high temperature properties, undergoes oxidation of the oxidizable constituents at a high rate and has a fine oxide particle size.

The method of making the Ag-CdO type material.

8 Claims, 2 Drawing Figures

ELECTRICAL CONTACT MATERIAL OF THE AG-CDO TYPE AND METHOD OF MAKING SAME

The present invention relates to a Ag-CdO type material suitable for use as an electrical contact material. The material is particularly useful as contact material in a circuit breaking device. The material contains Ag and CdO with oxides of Sn and an additive metal selected from Mg, Ca, or mixtures of oxides of such additive metals. The invention also relates to a method of making such Ag-CdO type material.

In general, electrical contact material consisting of Ag-CdO has better resistance to sticking and to arc erosion than does Ag electrical contact material. The contact resistance of Ag-CdO contact material is reasonably stable so it is useful at light (about 20 amperes) and heavy (above 100 amperes) current loads. However, Ag-CdO contact material is often unsatisfactory in situations where an instantaneous high temperature is developed at the working surface of the material, that is, instantaneous temperatures of about 1000°C or higher.

Electrical contact material consisting of Ag-CdO with an oxide of Sn has improved arc erosion wear and resistance to fusion when compared to Ag-CdO material. Such a contact material is disclosed in U.S. Pat. No. 3,607,244. However, electrical contact material consisting of Ag-CdO and an oxide of Sn experiences a slow oxidation rate during manufacture.

A feature of the present invention is to provide an electrical contact material of the Ag-CdO type wherein the oxidizable constituents are oxidized at a faster rate than Ag-Cd-Sn material by the addition of a metal that oxidizes earlier than either Cd or Sn thereby acting as a nucleating site for the oxidation of the Sn and Cd. A further feature of the invention is a Ag-CdO type material having a fine oxide particle size. Another feature is to provide an Ag-CdO type material wherein the instantaneous temperature at the working surface of the material can approach about 1000°C without harmful change experienced by the working surface. Another feature of the present invention is to provide an Ag-CdO type material having a hard-to-soft transition temperature of about 450°C or higher.

Figure 1:
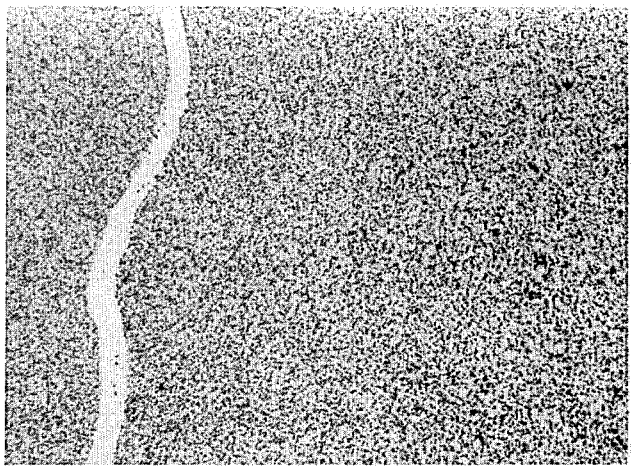
Figure 2:
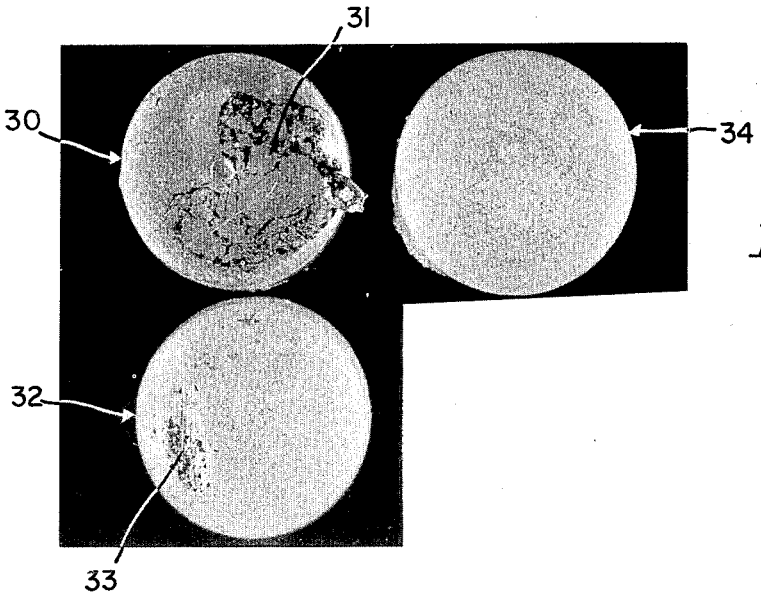

FIG. 1 is a photomicrograph of an internally oxidized Ag-CdO type contact material at about 340 magnifications containing about 9 wt.% Cd, about 1.5 wt.% Sn and about 0.06 wt.% Ca, the remainder Ag; and FIG. 2 is a photograph of three different types of Ag-CdO contact material heated to 1000°C for 10 minutes.

The oxidation rate of the oxidizable constituents, the instantaneous high temperature operating characteristics, the oxide particle structure, and the hard-to-soft transition temperature of an Ag-CdO type electrical contact material are improved over a Ag-CdO - oxide of Sn material by adding to Ag-Cd up to 2 wt.% Sn and up to about 0.1 wt.% of an additive metal selected from Mg, Ca, or mixtures of such metals and oxidizing the oxidizable constituents of the Ag-Cd type material. The microstructure comprises fine grains of the oxides of Cd, Sn and the additive metal. Preferably, the material contains an effective amount up to 2 wt.% Sn which is oxidized and an effective amount up to 0.1 wt.% additive metal which is oxidized.

Generally speaking, the present invention relates to a Ag-CdO type electrical contact material manufactured by oxidizing a Ag-Cd type material provided by forming a material consisting essentially of about 70 to about 95 wt.% Ag, about 5 to about 30 wt.% Cd, about 0.01 to about 2 wt.% Sn, and a small but effective amount to about 0.2 wt.% of an additive metal selected from Mg, Ca, or mixtures of the additive metals and oxidizing the oxidizable constituents of the material to provide a Ag-CdO type electrical contact material.

The additive metal appears to begin to oxidize prior to initiation of oxidation of either the Sn or Cd and appears to act as a nucleating site for the growth of the oxides of Sn and Cd as fine grains. An amount of additive metal less than about 0.001 wt.% does not make the nucleating effect distinguishable and an amount over about 0.15 wt.% increases the precipitation of Cd and Sn at the grain boundary, reduces the electrical conductivity and workability of the contact material, and substantially reduces the oxidation rate during manufacture of the Ag-CdO type material. Preferably, the additive metal content is about 0.01 to about 0.15 wt.%. The additive metal is miscible in the melt whereas metals such as Co, Fe or Ni are not miscible in the melt. It is important that the additive metal be miscible in the melt to provide a substantially homogenous mixture which after casting has substantially uniform physical and mechanical properties.

As seen in FIG. 1 the addition of the additive metal is effective in causing the grains of the oxides of Cd and Sn to be remarkably fine after the oxidation of the Ag-Cd type material. The particles of the mixed oxides of Cd, Ca and Sn of FIG. 1 have an average particle size generally less than about 3 microns. The particles (not shown) of the mixed oxides of Cd and Sn with no additive metal as taught in this invention have an average particle size of about 20 microns.

The electrical contact material of the present invention may be manufactured by either a post oxidation or a preoxidation technique. In regard to the preoxidation technique of oxidizing Ag-Cd type materials, U.S. reissue Pat. No. 27,075 and U.S. Pat. No. 3,545,067 teach processing parameters that can be used to oxidize the oxidizable constituents of the Ag-Cd type material of the present invention. In utilizing this technique a melt of Ag-Cd-Sn and the additive metal is prepared, atomized and oxidized. Subsequent to oxidation of the constituents, the contact material shape is formed. An excess of tin and/or additive metal may be added to allow for losses of tin and/or additive metal during melt preparation and/or atomization.

With regard to the post oxidation technique of oxidizing Ag-Cd type materials, U.S. Pat. Nos. 2,539,298 and 2,673,167 teach processing parameters that can be used to oxidize the oxidizable constituents of the Ag-Cd type material of the present invention. In this method the contact material shape is formed and then the oxidizable constituents of the shape are oxidized.

In general, in oxidizing the constituents of the material according to the preoxidation technique, or the finished or semi-finished shape according to the post oxidized technique, an oxidation temperature of up to about 850°C and a time of up to about 120 hours is required, depending upon the shape, the oxidizing temperature, and oxygen content of the atmosphere.

Assuming that the dimensions of a Ag-Cd-Sn material are the same as the Ag-Cd-Sn-additive material and the processing parameters are the same, the oxidation rate will be up to about 10% faster for the Ag-Cd-Sn-additive material than the oxidation rate for the Ag-Cd- Sn material. The Ag-CdO type material of the present invention appears to be able to withstand instantaneous temperatures up to about 1000°C better than the oxidized Ag-CdO-Sn material. For example, subjecting internally oxidized 9 Cd-1.5 Sn-89.5Ag material to a temperature of 1000°C for about 10 minutes will cause formation of an agglomerated pool of molten Ag on the surface of the material. Such a result experienced by the 9 Cd-1.5 Sn-89.5Ag material indicates that the Ag-CdO type material of the present invention is better able to withstand a higher instantaneous temperature thereby making the Ag-CdO type material of the present invention a more suitable contact material for a circuit breaking device than is the internally oxidized Ag-CdO-Sn material.

FIG. 2 shows slugs of three different internally oxidized composite materials after being exposed to 1000°C for 10 minutes. FIG. 2 shows that internally oxidized slug 30 (Ag-9Cd) experiences significant agglomeration of molten Ag 31 on its surface; internally oxidized slug 32 (Ag-9Cd-1.5 Sn) experiences agglomeration of molten Ag 33 on its surface; and internally oxidized slug 34, (Ag-9Cd-1.5 Sn-0.05 Ca) experiences little, if any, agglomeration of Ag on its surface.

At room temperature the hardness of the material of the present invention is about 90–95 $R_H$ whereas the hardness of Ag-CdO material at room temperature is about 80–85 $R_H$. The hard-to-soft transition temperature for the material of the present invention is about 450°C whereas the hard-to-soft transition temperature for Ag-CdO material is about 400°C.

The oxidation rate of the Ag-CdO type material is increased about 10% by the addition of an additive metal which has a greater affinity for oxygen than either Cd or Sn and forms a more stable oxide than either Cd or Sn forms. However, if the amount of the additive metal, Ca for example, exceeds about 0.15 wt.%, a heavy oxide precipitation begins to form along grain boundaries which appears to retard the oxidation rate of the Ag-CdO type material.

The additive metal is substantially uniformly distributed throughout the Ag-CdO type material of the present invention. Oxidizing the oxidizable constituents of the material of the present invention results in the additive metal forming an oxide of that metal prior to the formation of either of the oxides of Sn or Cd. The formation of an oxide of the additive metal appears to result in the oxide of that metal serving as the nuclei for the precipitation of the oxides of Sn and Cd thereby enhancing the rate of formation of the oxides of Sn and Cd. The oxides of the additive metal and Sn tend to become associated with the CdO particles.

The Ag-CdO contact material of the present invention tends to oxidize substantially uniformly throughout the contact material so that the electrical characteristics of the material tend to remain substantially the same as the working surface of the material wears.

Material of the present invention when exposed to a temperature of about 1000°C for about 10 minutes does not appear to form agglomerated pools of Ag on its working surface.

By additive metal, as used herein, we mean Ca, Mg and mixtures thereof. The preferred additive metal is Ca. The lower limit of the wt.% of the additive must be sufficient to function as a nucleating site for the formation of the oxides of Sn and Cd. However, if the amount of the additive metal exceeds 0.2 wt.% the desired effects appear to not be achieved. Most preferably, the amount of the additive metal is 0.1% or less.

The presence of small amounts of impurity elements is not believed to play a critical roll in the invention.

The present invention is described in its presently preferred embodiment. However, it should be understood that small quantities of additional metal constituents may be added without defeating the features of the Ag-CdO type material described above.

We claim:

1. Ag-CdO type material suitable for use as an electrical contact material, the material consisting essentially of Ag and Cd with about 0.01 wt% to about 2 wt.% Sn, and about 0.001 wt% to about 0.2 wt.% of a metal selected from Mg, Ca, or mixtures of such metals, the material oxidized so as to convert the oxidizable constituents to their respective oxides prior to use of the material as an electrical contact material.

2. The Ag-CdO type material of claim 1, wherein the oxide of Sn is the reaction product of heating Sn to an elevated temperature in an oxygen rich atmosphere, and wherein the oxide of the metal is the reaction product of heating such metal to an elevated temperature in an oxygen rich atmosphere.

3. The Ag-CdO type material of claim 1, wherein the metal is about 0.001 wt.% to about 0.1 wt% of the total weight of the material.

4. The Ag-CdO type material of claim 1, wherein the CdO and the oxide of Sn are substantially uniformly distributed throughout the material, the oxide of the metal selected from Mg, Ca, or mixtures of the oxides of such metals is substantially at the interface of the grains of CdO and the oxide of Sn.

5. The Ag-CdO type material of claim 4, wherein the mixed oxides of Cd, Sn and the additive metal has an average particle size of about 3 microns or less.

6. A method of making the Ag-CdO type contact material as claimed in claim 1 including the steps of forming a melt including Ag, Cd, Sn and a metal selected from Mg, Ca, or mixtures of such metals, forming the melt into a shape, and subjecting the shape to selective internal oxidation to convert the Cd, the Sn, and the metal selected from Mg, Ca, or mixtures of such selected metals to an oxide of each metal.

7. The metal of making the Ag-CdO type contact material of claim 6, wherein the step of subjecting the shape to selective internal oxidation includes heating in an oxygen rich atmosphere the Cd, the Sn and the metal selected from Mg, Ca, or mixtures of such metals to convert the metals to a reaction product including oxygen.

8. The Ag-CdO type material of claim 1, wherein the small but effective amount of the metal is about 0.001 wt.% to about 0.2 wt.% Ca, preferably about 0.001 to about 0.1 wt.% Ca, the oxide of Ca is substantially at the interface of the grains of the oxide of Cd and the oxide of Sn, the grains of the mixed oxides of Cd, Sn and Ca having an average particle size of about 3 microns or less.

* * * * *